US010686254B2

(12) United States Patent
Cai et al.

(10) Patent No.: US 10,686,254 B2
(45) Date of Patent: Jun. 16, 2020

(54) WIDEBAND ANTENNA SYSTEM

(71) Applicant: The Boeing Company, Chicago, IL (US)

(72) Inventors: Lixin Cai, Seattle, WA (US); Alec Adams, Renton, WA (US); Manny S. Urcia, Jr., Wildwood, MO (US)

(73) Assignee: The Boeing Company, Chicago, IL (US)

( * ) Notice: Subject to any disclaimer, the term of this patent is extended or adjusted under 35 U.S.C. 154(b) by 15 days.

(21) Appl. No.: 15/609,851

(22) Filed: May 31, 2017

(65) Prior Publication Data

US 2018/0366831 A1 Dec. 20, 2018

(51) Int. Cl.

| | |
|---|---|
| ***H01Q 13/10*** | (2006.01) |
| ***H01Q 9/16*** | (2006.01) |
| ***H01Q 21/00*** | (2006.01) |
| ***H01Q 13/18*** | (2006.01) |
| ***H01Q 1/38*** | (2006.01) |
| *H01Q 21/06* | (2006.01) |
| *H01Q 1/28* | (2006.01) |
| *H01Q 3/26* | (2006.01) |

(52) U.S. Cl.

CPC ..... *H01Q 13/103* (2013.01); *H01Q 1/38* (2013.01); *H01Q 9/16* (2013.01); *H01Q 13/106* (2013.01); *H01Q 13/18* (2013.01); *H01Q 21/0075* (2013.01); *H01Q 1/28* (2013.01); *H01Q 3/26* (2013.01); *H01Q 21/064* (2013.01)

(58) Field of Classification Search

CPC .... H01Q 13/10; H01Q 13/103; H01Q 13/106; H01Q 13/18; H01Q 21/0075; H01Q 21/0081

See application file for complete search history.

(56) References Cited

U.S. PATENT DOCUMENTS

| | | | | |
|---|---|---|---|---|
| 4,197,545 A * | 4/1980 | Favaloro | H01Q 13/106 | 343/700 MS |
| 4,903,033 A * | 2/1990 | Tsao | H01Q 9/0414 | 343/700 MS |
| 5,337,065 A * | 8/1994 | Bonnet | H01Q 13/18 | 343/700 MS |
| 6,028,561 A * | 2/2000 | Takei | H01Q 13/103 | 343/700 MS |
| 7,106,264 B2 * | 9/2006 | Lee | H01Q 13/10 | 343/767 |
| 8,749,434 B2 * | 6/2014 | Han | H01Q 1/40 | 343/700 MS |

OTHER PUBLICATIONS

Yoshimura, "A Microstripline Slot Antenna," IEEE Transactions on Microwave Theory Techniques, Nov. 1972, pp. 760-762.

(Continued)

*Primary Examiner* — Daniel Munoz
*Assistant Examiner* — Patrick R Holecek
(74) *Attorney, Agent, or Firm* — Yee & Associates, P.C.

(57) ABSTRACT

A system, method, and apparatus for an antenna system. The antenna system comprises an aperture structure, a primary radiating slot, a tuning slot, and a stripline feed. The primary radiating slot and the tuning slot are both located in the aperture structure. The stripline feed is located between the primary radiating slot and the tuning slot in the aperture structure.

26 Claims, 6 Drawing Sheets

(56) References Cited

OTHER PUBLICATIONS

Hirokawa et al., "Cavity-backed wide slot antenna," IEE Proceedings, vol. 136, Feb. 1989, pp. 29-33.
Li et al., "Microstrip-Fed Cavity-Backed Slot Antennas," Microwave and Optical Technology Letters, vol. 33, Issue No. 4, May 2002, pp. 229-233.
Li et al., "Inverted Microstrip-Fed Cavity-Backed Slot Antennas," IEEE Antennas and Wireless Propagation Letters, vol. 1, 2002, pp. 98-101.
Behdad et al., "A Wide-Band Slot Antenna Design Employing a Fictitious Short Circuit Concept," IEEE Transactions on Antennas and Propagation, vol. 53, No. 1, Jan. 2005, pp. 475-482.
Vallecchi et al., "Microstrip-Fed Slot Antennas Backed by a Very Thin Cavity," Microwave and Optical Technology Letters, vol. 49, No. 1, Jan. 2007, pp. 247-250.
Hanqing et al., "High Gain Cavity-Backed Slot Antenna With a Windowed Metallic Superstrate," Microwave and Optical Technology Letters, vol. 50, No. 12, Dec. 2008, pp. 3114-3118.

* cited by examiner

WIDEBAND ANTENNA SYSTEM

BACKGROUND INFORMATION

1. Field

The present disclosure relates generally to antennas, and in particular, to wideband beam-forming antennas that are electronically scanned.

2. Background

Antenna systems are used to send or receive radio frequency (RF) signals. These radio frequency signals often include information such as voice communications, images, messages, and other types of information.

One type of antenna system commonly used is a directional or beam-forming antenna. This type of antenna radiates or receives greater power in specific directions allowing for increased system performance and reduced interference to unintended receivers or from unintended transmitters. Wideband antennas are often used when substantial frequency range or multiple functions are desired. For example, aircraft wideband antennas may have multiple functions such as sensors, communications, and electronic warfare. Further, the beams from these antennas are often steered. The steering of the beams may be performed electronically or mechanically.

With respect to the use of these types of antennas on aircraft, weight and size are often a factor, in addition to performance. For example, motorized gimbals have been used to mechanically steer beams from antennas. Motorized gimbals, however, increase the weight and require additional space in the aircraft, and limit the beam-steering rate to lower than necessary for some applications.

Electronically steered antennas may be used to reduce weight and improve beam agility. However, typical radiators used in these types of antennas also result in more weight than desired for some applications. For example, existing electronically steered antennas often employ heavy and bulky slotted waveguides formed from rectangular copper pipes as used with some current architectures below Ku-band. This type of solution may be lighter than the use of a gimbal for azimuth, elevation scan, or both, but still may not meet desired weight requirements for some applications on aircraft or other types of vehicles, such as a spacecraft.

Therefore, it would be desirable to have a method and apparatus that take into account at least some of the issues discussed above, as well as other possible issues. For example, it would be desirable to have a method and apparatus that overcome a technical problem with steering beams over wide frequency range and field-of-regard from an antenna using an architecture that has a desired weight and performance.

SUMMARY

An embodiment of the present disclosure provides an antenna system. The antenna system comprises an aperture structure, a primary radiating slot, a tuning slot, and a stripline feed. The primary radiating slot and the tuning slot are both located in the aperture structure. The stripline feed is located between the primary radiating slot and the tuning slot in the aperture structure.

Another embodiment of the present disclosure provides an antenna system. The antenna system comprises a top section, sidewalls, a bottom section, a primary radiating slot, a tuning slot, and a stripline feed. The top section has a first dielectric substrate layer with a first metal layer and a second dielectric substrate layer with a second metal layer. The primary radiating slot is formed in the first dielectric substrate layer with the first metal layer and the tuning slot is formed in the second dielectric substrate layer with the second metal layer. The sidewalls comprise a third dielectric substrate layer and a third metal layer. The bottom section has a bottom dielectric substrate layer with a bottom metal layer for a ground in the antenna system. The top section, the sidewalls, and the bottom section form an antenna cavity in an aperture structure. The primary radiating slot and the tuning slot are in the top section. The stripline feed is located between the primary radiating slot and the tuning slot in the top section that is offset from a center line in the top section. The top section, the sidewalls, and the bottom section form the aperture structure.

Yet another embodiment of the present disclosure provides a method for exchanging radio frequency signals. The method comprises exchanging signals using a stripline feed in an aperture structure that includes a primary radiating slot and a tuning slot. The stripline feed is located between the primary radiating slot and the tuning slot in the aperture structure.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

The illustrative embodiments recognize and take into account one or more different considerations. For example, the illustrative embodiments recognize and take into account that current architectures for antennas, such as antennas that are wideband antennas and have steerable beams, may be heavier than desired for application in vehicles, such as aircraft and spacecraft. The illustrative embodiments recognize and take into account that the design of antenna elements may be designed to have a lighter weight than those currently used in electronically steerable antenna elements.

Further, the illustrative embodiments recognize and take into account that currently available antenna elements for wideband applications may be narrower in usable bandwidth over scan volume or field-of-regard and more expensive than desired. Bandwidth classification for antennas is often expressed as a percentage bandwidth (frequency range divided by center frequency). For example, under 10% is typically considered narrow bandwidth while over 15% is considered wideband. The bandwidth from 10% to 15% may be consider narrow or wideband.

Thus, the illustrative embodiments provide a method and apparatus for an antenna system. In one illustrative example, the antenna system includes an aperture structure, a primary radiating slot, a tuning slot, and a stripline feed. The primary radiating slot and the tuning slot are located in the aperture structure. The stripline feed is located between the primary radiating slot and the tuning slot in the aperture structure.

Figure 1:
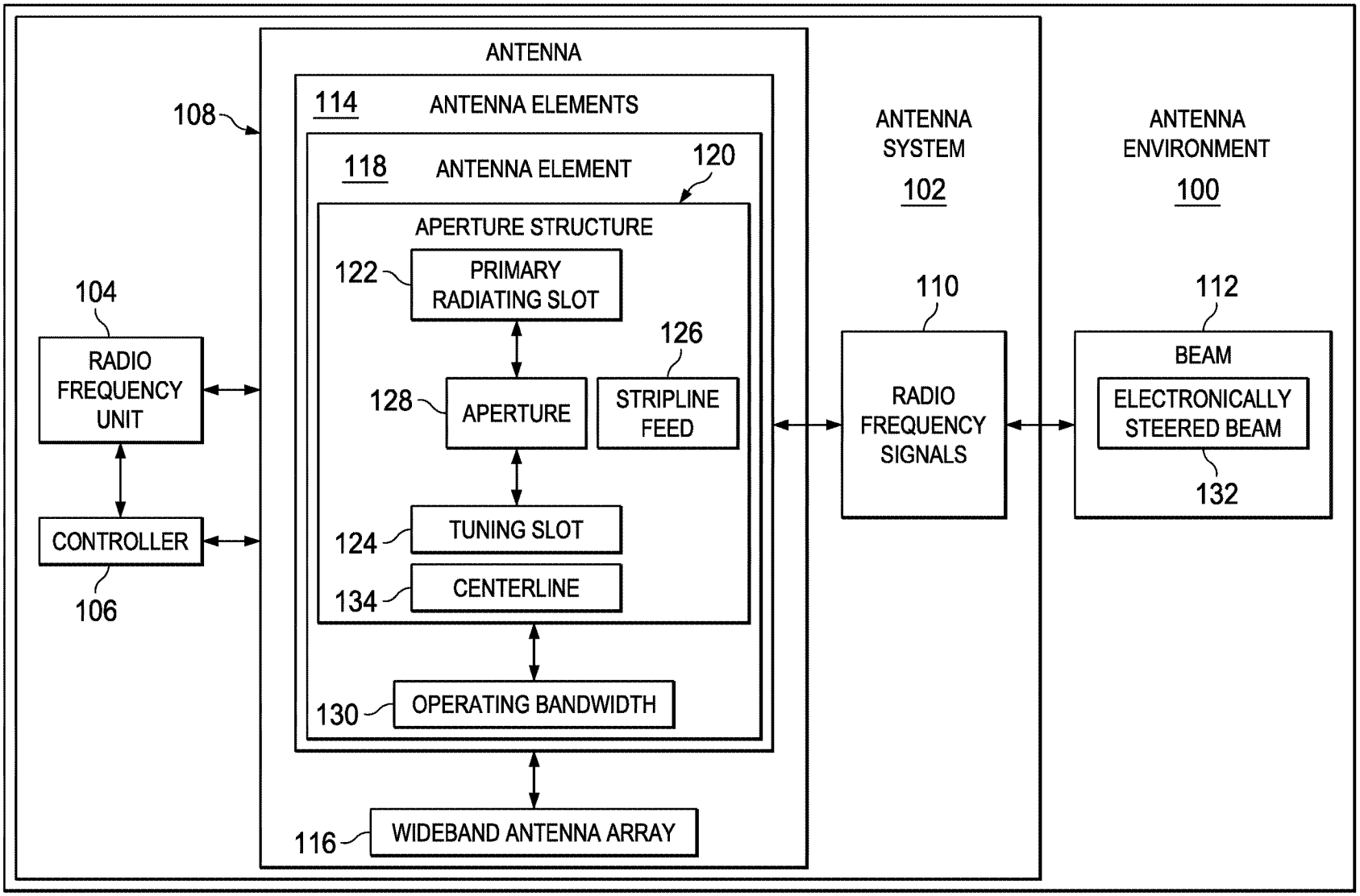
FIG. 1 is an illustration of a block diagram of an antenna environment in accordance with an illustrative embodiment.

With reference now to the figures, and in particular with reference to FIG. 1, an illustration of a block diagram of an antenna environment is depicted in accordance with an illustrative embodiment. As depicted, antenna environment 100 includes antenna system 102. Antenna system 102 includes radio frequency unit 104, controller 106, and antenna 108.

In this illustrative example, radio frequency unit 104 may include at least one of a transmitter or a receiver for exchanging radio frequency signals 110. As used herein, the phrase "at least one of", when used with a list of items, means different combinations of one or more of the listed items may be used, and only one of each item in the list may be needed. In other words, "at least one of" means any combination of items and number of items may be used from the list, but not all of the items in the list are required. The item may be a particular object, a thing, or a category.

For example, without limitation, "at least one of item A, item B, or item C" may include item A, item A and item B, or item C. This example also may include item A, item B, and item C; or item B and item C. Of course, any combinations of these items may be present. In some illustrative examples, "at least one of" may be, for example, without limitation, two of item A, one of item B, and ten of item C; four of item B and seven of item C; or other suitable combinations.

Controller 106 controls the operation of antenna elements 114 in an array environment. Controller 106 may be implemented in at least one of hardware or software. Controller 106 may be a processor unit in a computer system or a specialist circuit depending on the particular implementation.

As depicted, controller 106 may control the phases or time-delays at which radio frequency signals 110 are exchanged to form beam 112. In this illustrative example, beam 112 is electronically steerable. In other words, a mechanical system to move antenna 108 is not needed to steer beam 112.

As depicted, antenna 108 is comprised of antenna elements 114. In this illustrative example, antenna elements 114 form wideband antenna array 116 for antenna 108.

In this illustrative example, antenna element 118 in antenna elements 114 is comprised of aperture structure 120, primary radiating slot 122, tuning slot 124, and stripline feed 126. In this illustrative example, stripline feed 126 is a quasi-transverse electromagnetic transmission line medium. Stripline feed 126 may be a flat strip of metal sandwiched between two parallel ground plates.

Primary radiating slot 122 is located in aperture structure 120. Tuning slot 124 is also located in aperture structure 120. As depicted, primary radiating slot 122 and tuning slot 124 form aperture 128 in aperture structure 120.

In this illustrative example, stripline feed 126 is located between primary radiating slot 122 and tuning slot 124 in aperture structure 120. As depicted, stripline feed 126 is offset from center line 134 of aperture structure 120.

In designing antenna element 118, at least one of a dimension and a position of primary radiating slot 122, tuning slot 124, and stripline feed 126 are selected for setting operating bandwidth 130 for aperture structure 120. Operating bandwidth 130 is a range of frequencies in which aperture structure 120 may send or receive radio frequency signals 110. In another example, operating bandwidth 130 may be described as a percentage of operating frequencies relative to a center frequency. Further, at least one of a position or the dimensions of stripline feed 126 are selected for impedance matching to aperture 128 formed by primary radiating slot 122 and tuning slot 124.

In this depicted example, antenna element 118, along with antenna elements 114, form beam 112 from radio frequency signals 110. Beam 112 is in the form of electronically steered beam 132. In this depicted example, the steering of electronically steered beam 132 is controlled by controller 106.

Figure 2:
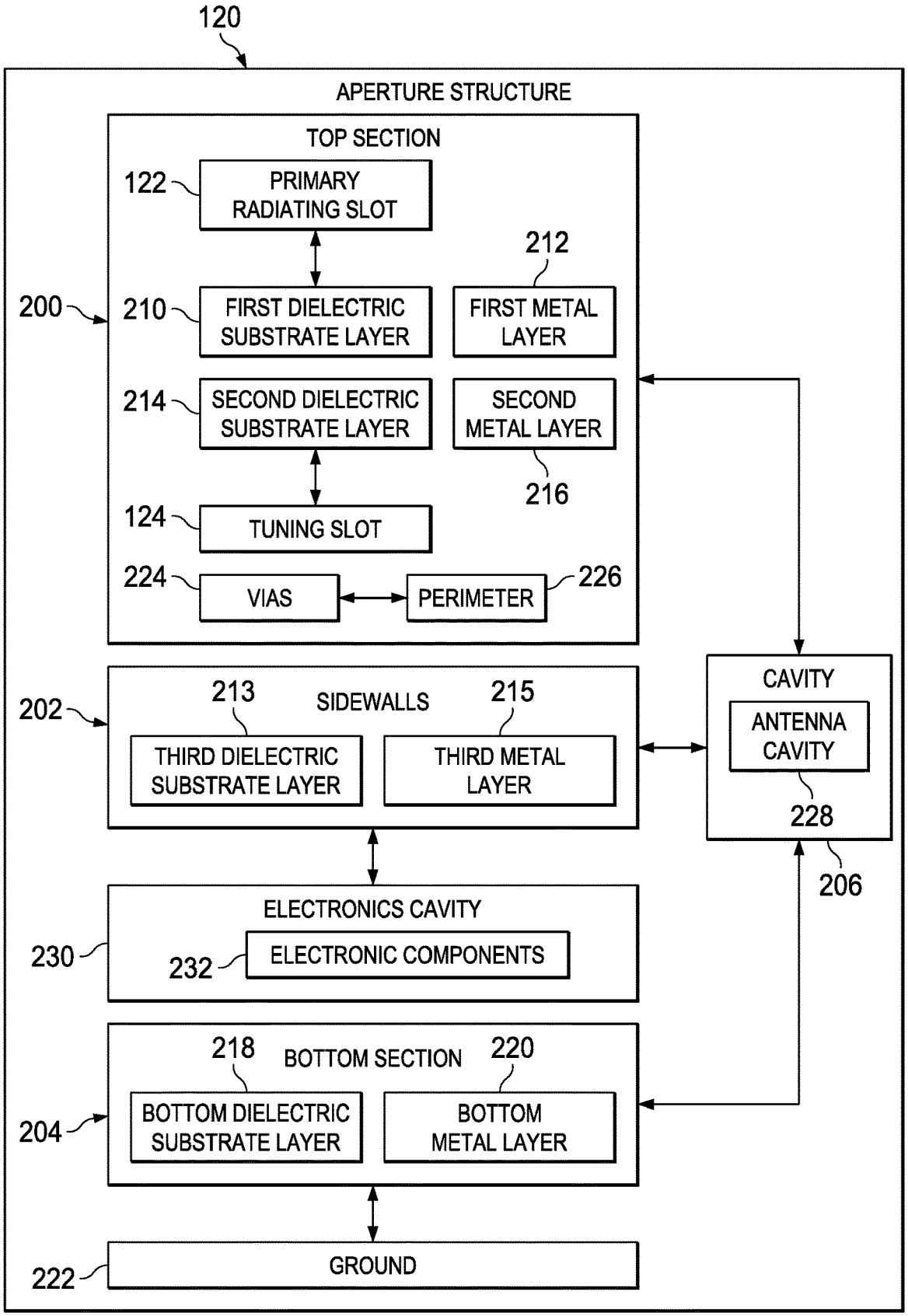
FIG. 2 is an illustration of a block diagram of an aperture structure in accordance with an illustrative embodiment.

With reference now to FIG. 2, an illustration of a block diagram of an aperture structure is depicted in accordance with an illustrative embodiment. FIG. 2 depicts an example of one implementation for aperture structure 120 in FIG. 1.

Aperture structure 120 is comprised of a number of different components. As depicted, aperture structure 120 is comprised of top section 200, sidewalls 202, and bottom section 204. Aperture structure 120 also includes cavity 206, which is formed by top section 200, sidewalls 202, and bottom section 204.

As depicted, top section 200 has first dielectric substrate layer 210 with first metal layer 212 and second dielectric substrate layer 214 with second metal layer 216. The layers of substrate for first dielectric substrate layer 210 and second dielectric substrate layer 214 may be printed circuit boards (PCBs). First metal layer 212 and second metal layer 216 are comprised of a metal selected from at least one of a metal alloy, copper, aluminum, silver, gold, or some other material with a desired level of conductivity.

In this example, primary radiating slot 122 is formed in first dielectric substrate layer 210 with first metal layer 212. Tuning slot 124 is formed in second dielectric substrate layer 214 with the second metal layer 216.

In this illustrative example, sidewalls 202 are formed from third dielectric substrate layer 213 and third metal layer 215 on the side facing cavity 206. Bottom section 204 has bottom dielectric substrate layer 218 with bottom metal layer 220. Ground 222 in antenna system 102 shown in FIG. 1 is formed from bottom metal layer 220.

In this example, vias 224 are located in the top section 200. Vias 224 are in locations that define perimeter 226 around primary radiating slot 122 and tuning slot 124.

A via is a vertical interconnected access that may be used to provide an electrical connection. A via is a small opening through the dielectric substrate in top section 200 that allows for a conductive connection between components on either side of top section 200. In this illustrative example, vias 224 also function as a Faraday cage that is an enclosure to block electromagnetic fields. In this manner, external interfering radio frequency signals may be weakened or prevented from being added to those being exchanged through aperture 128 in FIG. 1.

As depicted, cavity 206 is a cavity in which radio frequency signals are generated and transmitted, or received. Cavity 206 is filled with a group of materials. The group of materials in cavity 206 may be selected from at least one of air, a foam, or some other suitable material. Other materials may be selected to have a desired weight and dielectric constant.

Further, sidewalls 202 may define one or more cavities, in addition to cavity 206. In the illustrative example, cavity 206 is antenna cavity 228 and sidewalls 202 form electronics cavity 230 in aperture structure 120. A group of electronic components 232 is associated with electronics cavity 230. The group of electronic components 232 is selected from at least one of an amplifier, a filter, a phase shifter, a time delay device, or some other suitable type of component. Electronic components 232 may be selected for signal conditioning or distribution.

Thus, in one illustrative example, one or more technical solutions are present that overcome a technical problem with steering beams from an antenna using an architecture that has a desired weight and performance. As a result, one or more technical solutions may provide a technical effect in which an antenna element has an aperture formed from two slots that provide a desired level of performance over different frequencies. One or more technical solutions may provide a wide band antenna array with a desired level of weight and cost as compared to current solutions. Further, one or more technical solutions also may provide an ability for a beam to be scanned over a wide bandwidth and at many angles within a desired scan volume or field-of-regard. The bandwidth and angle over which a beam may be scanned are approximately the same or greater, in the illustrative examples, compared to currently used much-heavier antenna elements for the intended applications.

The illustration of antenna environment 100 FIGS. 1, aperture structure 120 in FIG. 2, and the different components in these environments is not meant to imply physical or architectural limitations to the manner in which an illustrative embodiment may be implemented. Other components, in addition to or in place of the ones illustrated, may be used. Some components may be unnecessary. Also, the blocks are presented to illustrate some functional components. One or more of these blocks may be combined, divided, or combined and divided into different blocks when implemented in an illustrative embodiment.

Figure 3:
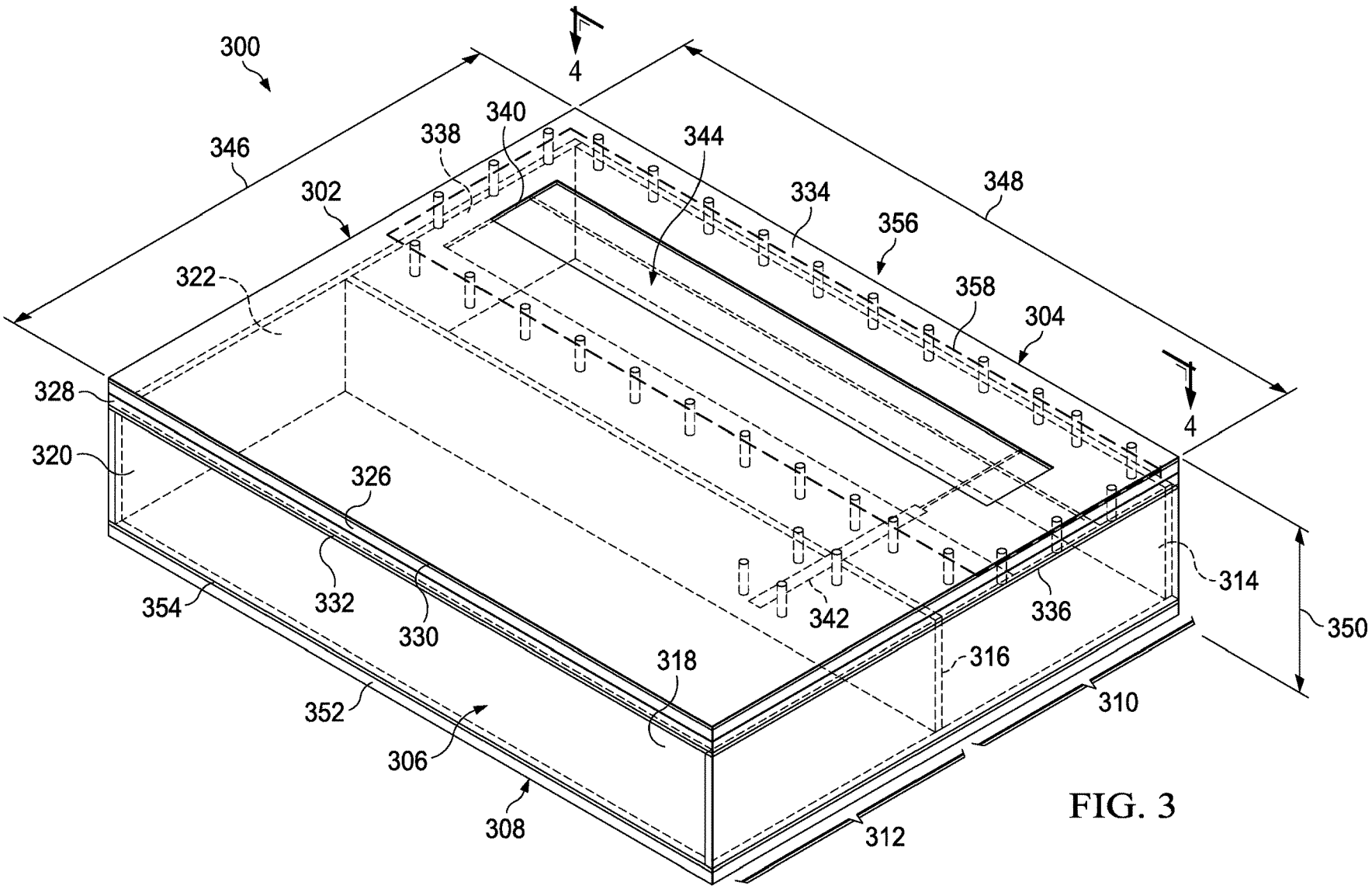
FIG. 3 is an illustration of an antenna element in accordance with an illustrative embodiment.

With reference next to FIG. 3, an illustration of an antenna element is depicted in accordance with an illustrative embodiment. In this illustrative example, antenna element 300 is shown in a prospective view with some components in phantom.

As depicted, antenna element 300 is an example of a physical implementation for antenna element 118 shown in block form in FIG. 1. In this illustrative example, antenna element 300 includes aperture structure 302, top section 304, sidewalls 306, and bottom section 308. In this illustrative example, sidewalls 306, along with top section 304 and bottom section 308, define two cavities, antenna cavity 310 and electronics cavity 312.

As depicted, sidewalls 306 include sidewall 314, sidewall 316, sidewall 318, sidewall 320, and sidewall 322. In this example, each of sidewalls 306 is comprised of a dielectric substrate layer and a metal layer, which are not shown in detail to avoid obscuring a description of other features in antenna element 300.

In this example, sidewall 314, sidewall 316, sidewall 320, and sidewall 322, with top section 304 and bottom section 308, define antenna cavity 310. Sidewall 314, sidewall 316, sidewall 318, and sidewall 320 with top section 304 and bottom section 308, define electronics cavity 312.

As depicted, top section 304 is comprised of first dielectric substrate layer 326, second dielectric substrate layer 328, first metal layer 330, and second metal layer 332. First dielectric substrate layer 326 is a first layer of a dielectric substrate. Second dielectric substrate layer 328 is a second layer of a dielectric substrate.

First metal layer 330 is located on first dielectric substrate layer 326 of outer surface 334 of aperture structure 302. Second metal layer 332 is located on second dielectric substrate layer 328 on inner surface 336 of aperture structure 302. Both first metal layer 330 and second metal layer 332 are comprised of copper in this illustrative example.

In this example, primary radiating slot 340 is formed in first dielectric substrate layer 326 and first metal layer 330. Tuning slot 338 is formed in second dielectric substrate layer 328 and second metal layer 332. In this illustrative example, primary radiating slot 340 has a smaller area than tuning slot 338. As depicted, primary radiating slot 340 is above tuning slot 338 in top section 304.

As depicted, stripline feed 342 is located between first dielectric substrate layer 326 and second dielectric substrate layer 328. Stripline feed 342 is located between tuning slot 338 and primary radiating slot 340.

At least one of a position, a length, or a shape of stripline feed 342 are tuning parameters for impedance matching to aperture 344 formed by tuning slot 338 and primary radiating slot 340. Tuning slot 338 provides an additional mechanism for impedance bandwidth tuning. Both tuning slot 338 and primary radiating slot 340 may be selected to control a dominant resonance frequency for aperture structure 302.

In this illustrative example, bottom section 308 is comprised of bottom dielectric substrate layer 352 and bottom metal layer 354. Bottom metal layer 354 is located on inner surface 336 of aperture structure 302.

In this illustrative example, vias 356 is located in top section 304. As can be seen, vias 356 form perimeter 358 that function as a Faraday cage around tuning slot 338 and primary radiating slot 340. The Faraday cage also prevents the excitation of undesired and commonly-known parallel-plate modes.

As depicted, aperture structure 302 has width 346, length 348, and height 350. The overall unit cell width that is parallel to a feed line axis is width 346, and may be selected to allow a grating-lobe-free electronic scan up to 60 degree on a vertical plane parallel to width 346, and over the intended frequency band of operation. Width 346 may be increased or decreased if the 60 degree off-boresight scan limit is decreased or increased. In one illustrative example, 1.7 inches for width 346 allows for a 60 degree off-boresight scan up to about 3.7 GHz.

Length 348 is a unit cell length and is selected to allow a grating-lobe-free electronic scan up to 25 degree on a vertical plane parallel to length 348, and over the intended frequency band of operation. As depicted, length 348 may be increased or decreased if the 25 degree off-boresight scan limit is decreased or increased. In an illustrative example, 2.2 inches for length 348 allows for a 25 degree off-boresight scan up to about 3.7 GHz. A percentage bandwidth of 18% or more can be present in this depicted example.

As depicted, the dimensions for antenna cavity 310 are selected such that undesired cavity modes interfering with the slot radiator operation do not occur. The height for the cavity, or distance from the slot to the horizontal ground on bottom section 308 is also chosen to redirect backward radiation to the forward direction for increased antenna gain and to provide an additional mechanism for impedance bandwidth tuning.

The dielectric substrate layers are formed from circuit boards in which the thicknesses of the circuit boards are selected such that the overall structure meets mechanical stress requirements. The thicknesses and dielectric constants of the circuit boards supporting stripline feed 342 are also selected such that the corresponding feed line dimensions meet manufacturability constraints.

In another illustrative embodiment, the location of primary radiating slot 340 and tuning slot 338 can be exchanged with minor retuning. Also, a thin non-metallic environmental coating may be placed on top of first metal layer 330. For example, the coating may be used to prevent corrosion of copper in the circuit boards.

As depicted, top section 304, sidewalls 306, and bottom section 308 in aperture structure 302 are comprised of printed circuit boards. These printed circuit boards may be fabricated separately and are bonded together in a final assembly with other aperture structures to form an egg crate structure in an array setting in which other antenna elements are present in addition to antenna element 300 and arranged in an array, such that radio-frequency signals may be exchanged using an electronically steered beam. An egg crate structure for an antenna is formed by interconnected dielectric panels in the antenna elements with typically uniform spacing and rectangular lattice.

Figure 4:
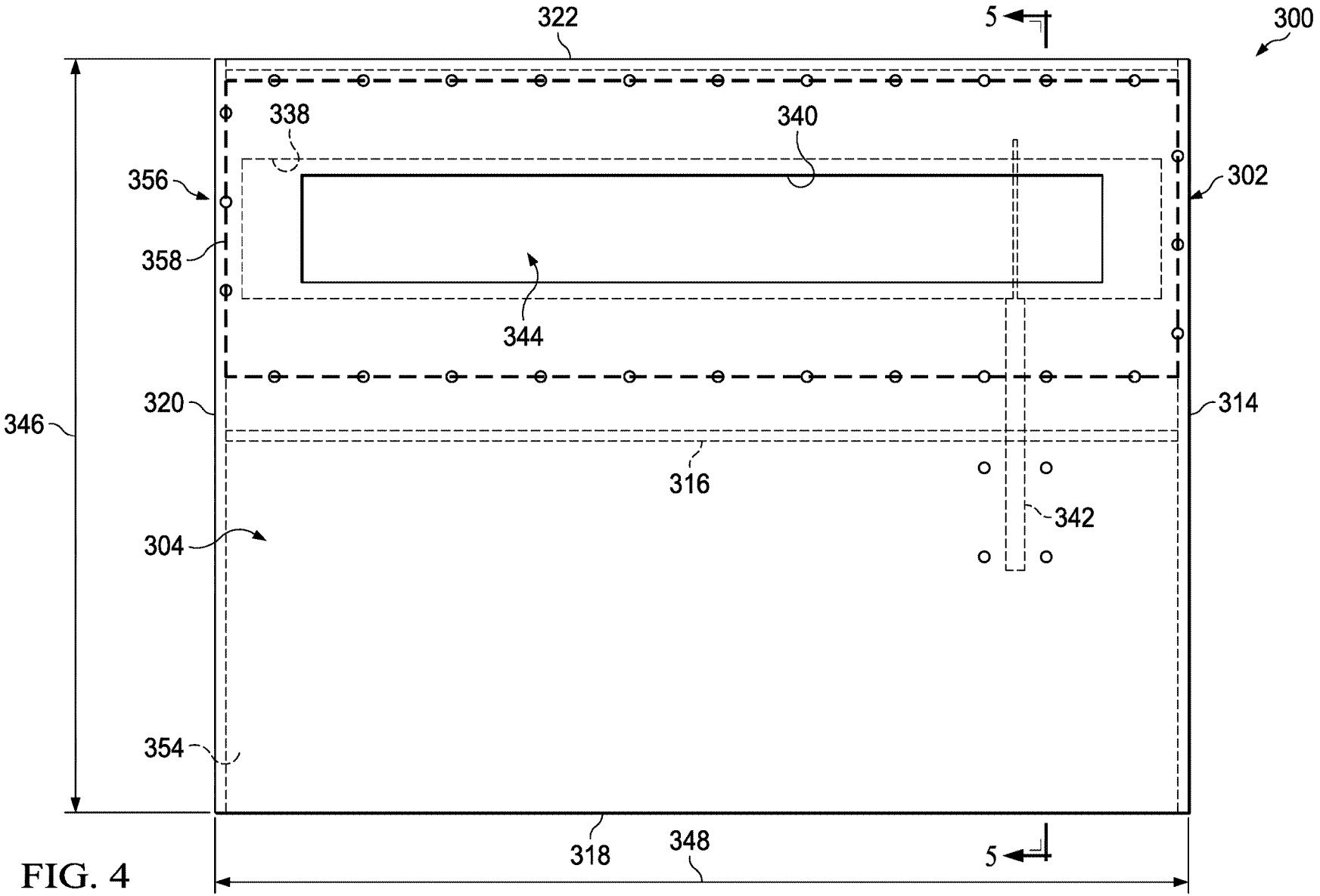
FIG. 4 is an illustration of a top view of an antenna element in accordance with an illustrative embodiment.

With reference now to FIG. 4, an illustration of a top view of an antenna element is depicted in accordance with an illustrative embodiment. In this illustrative example, the top view of antenna element 300 is seen in the direction of lines 4-4 in FIG. 3.

In this view, aperture 344 is shown with vias 356 forming perimeter 358 surrounding primary radiating slot 340, tuning slot 338, and stripline feed 342. Vias 356 may function to reduce or suppress undesirable parallel plate modes between two ground planes and isolate primary radiating slot 340 from the power distribution circuits in an array (not shown) and stripline feeds from neighboring antenna elements. The diameter and density of vias 356 may be selected such that vias 356 form a Faraday cage providing a desired electrical shield over the intended frequency band of operation by antenna element 300.

Figure 5:
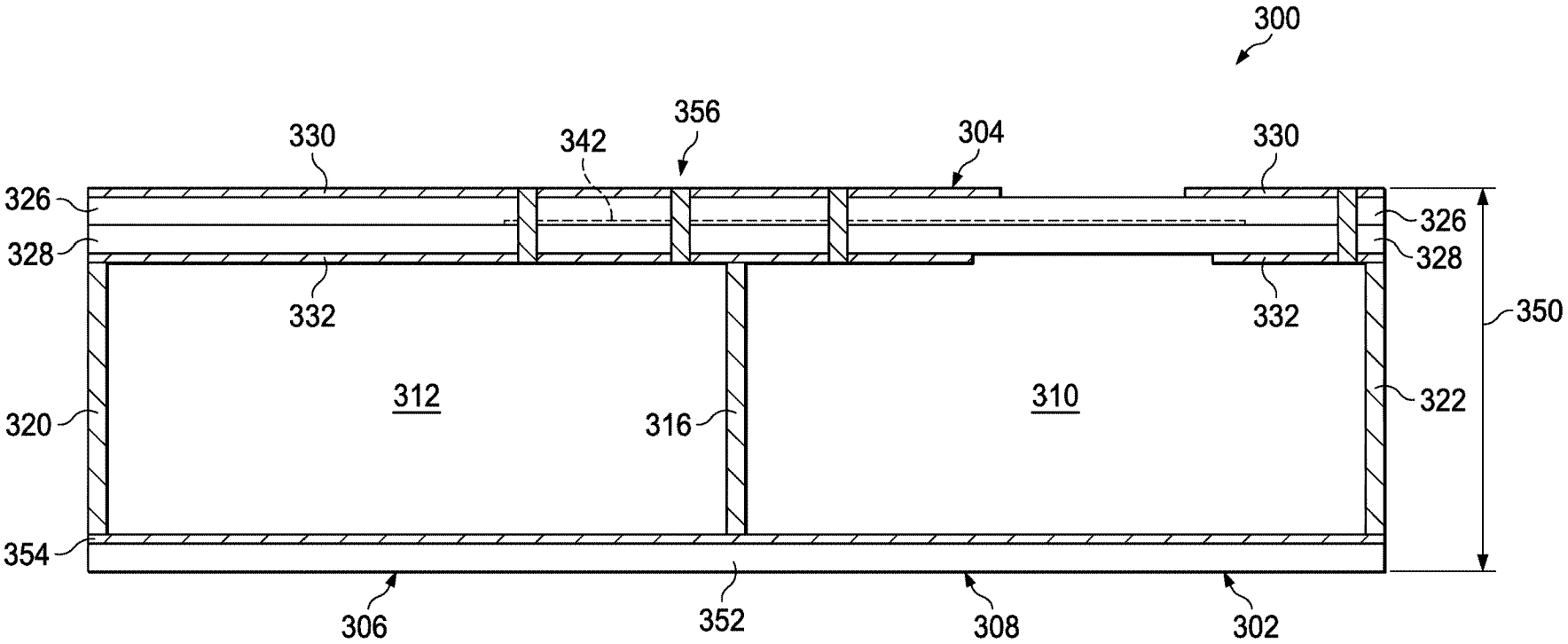
FIG. 5 is an illustration of a cross-sectional view of an antenna element in accordance with an illustrative embodiment.

Turning now to FIG. 5, an illustration of a cross-sectional view of an antenna element is depicted in accordance with an illustrative embodiment. As depicted, this cross-sectional view of antenna element 300 is taken along lines 5-5 in FIG. 4.

In this view, the relative thicknesses of top section 304 and stripline feed 342 within top section 304 and antenna cavity 310 are seen. In this particular example, height 350 of aperture structure 302 is about 0.14 wavelengths in free space at a mid-band frequency. The main cavity redirects backward radiation to the forward direction for increased antenna gain. This type of cavity also reduces undesired mutual coupling with neighboring antenna elements.

As depicted, electronics cavity 312 is used to house active or passive electronics, if necessary, depending on the need to scan both elevation and azimuth, or just on an elevation plane parallel to a feed line axis. The electronics that may be placed in electronics cavity 312 include at least one of an amplifier, a filter for signal conditioning, a phase shifter, or a time-delay device for antenna array beam steering.

Figure 6:
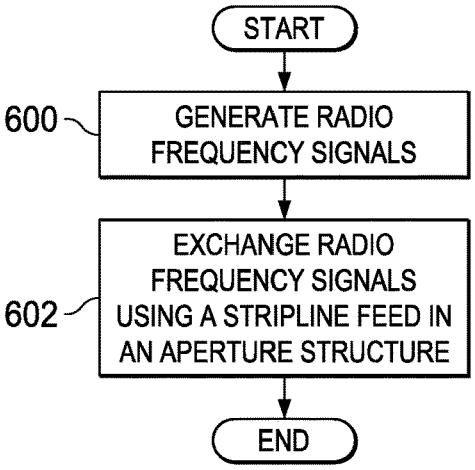
FIG. 6 is an illustration of a flowchart of a process for exchanging radio frequency signals in accordance with an illustrative embodiment.

Turning next to FIG. 6, an illustration of a flowchart of a process for exchanging radio frequency signals is depicted in accordance with an illustrative embodiment. The process illustrated in FIG. 6 may be implemented using antenna system 102 in FIG. 1. Exchanging radio frequency signals includes at least one of transmitting radio frequency signals or receiving radio frequency signals.

The process begins by generating radio frequency signals (operation 600). The process exchanges radio frequency signals using a stripline feed in an aperture structure (operation 602). The process terminates thereafter. The aperture structure includes a primary radiating slot and a tuning slot. The stripline feed is located between the primary radiating slot and the tuning slot in the aperture structure.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent at least one of a module, a segment, a function, or a portion of an operation or step. For example, one or more of the blocks may be implemented as program code, hardware, or a combination of program code and hardware. When implemented in hardware, the hardware may, for example, take the form of integrated circuits that are manufactured or configured to perform one or more operations in the flowcharts or block diagrams. When implemented as a combination of program code and hardware, the implementation may take the form of firmware. Each block in the flowcharts or the block diagrams may be implemented using special purpose hardware systems that perform the different operations or combinations of special purpose hardware and program code run by the special purpose hardware.

In some alternative implementations of an illustrative embodiment, the function or functions noted in the blocks may occur out of the order noted in the figures. For example, in some cases, two blocks shown in succession may be performed substantially concurrently, or the blocks may sometimes be performed in the reverse order, depending upon the functionality involved. Also, other blocks may be added, in addition to the illustrated blocks, in a flowchart or block diagram.

Figure 7:
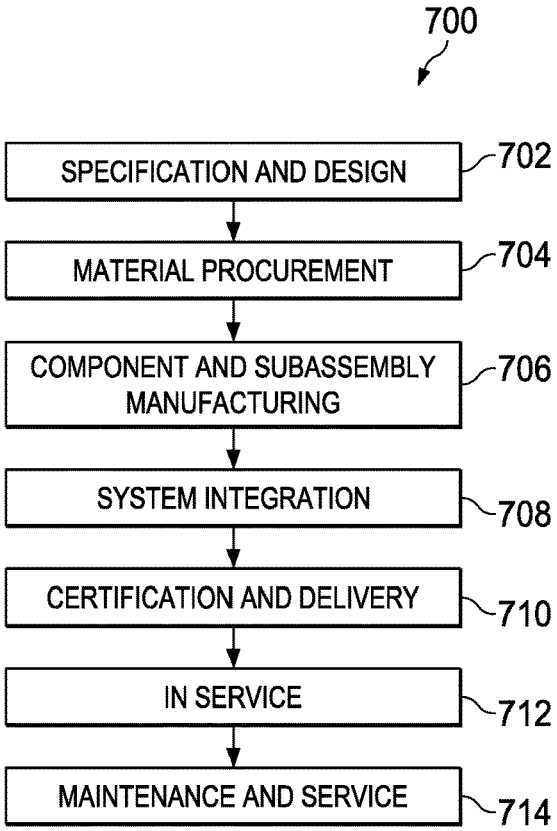
FIG. 7 is an illustration of a block diagram of an aircraft manufacturing and service method in accordance with an illustrative embodiment.
Figure 8:
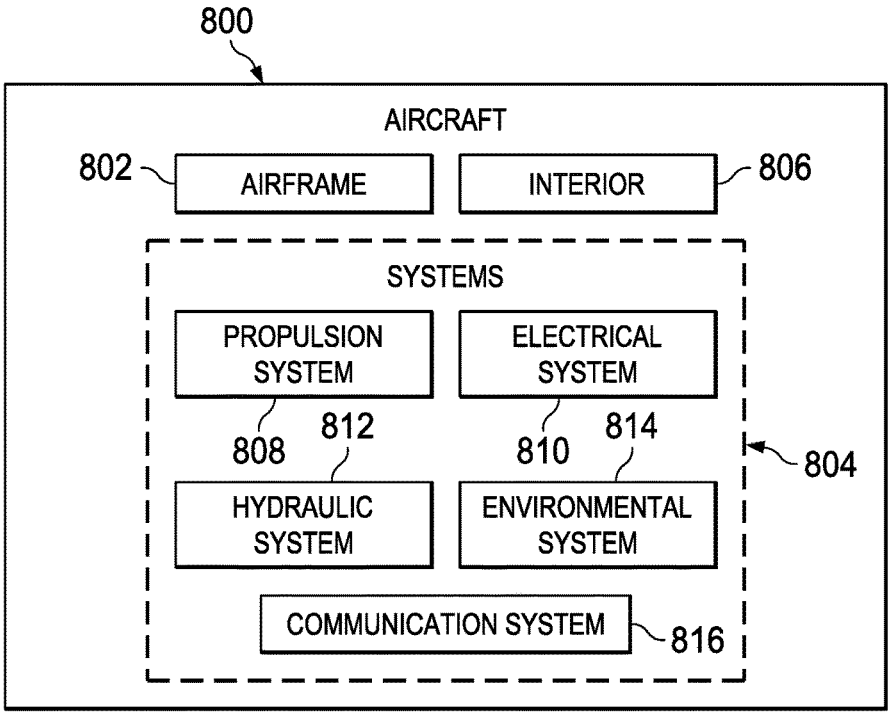
FIG. 8 is an illustration of a block diagram of an aircraft in accordance with an illustrative embodiment.

The illustrative embodiments of the present disclosure may be described in the context of aircraft manufacturing and service method 700 as shown in FIG. 7 and aircraft 800 as shown in FIG. 8. Turning first to FIG. 7, an illustration of a block diagram of an aircraft manufacturing and service method is depicted in accordance with an illustrative embodiment. During pre-production, aircraft manufacturing and service method 700 may include specification and design 702 of aircraft 800 in FIG. 8 and material procurement 704.

During production, component and subassembly manufacturing 706 and system integration 708 of aircraft 800 in FIG. 8 takes place. Thereafter, aircraft 800 in FIG. 8 may go through certification and delivery 710 in order to be placed in service 712. While in service 712 by a customer, aircraft 800 in FIG. 8 is scheduled for routine maintenance and service 714, which may include modification, reconfiguration, refurbishment, and other maintenance or service.

Each of the processes of aircraft manufacturing and service method 700 may be performed or carried out by a system integrator, a third party, an operator, or some combination thereof. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, a leasing company, a military entity, a service organization, and so on.

With reference now to FIG. 8, an illustration of a block diagram of an aircraft is depicted in accordance with an illustrative embodiment. In this example, aircraft 800 is produced by aircraft manufacturing and service method 700 in FIG. 7 and may include airframe 802 with plurality of systems 804 and interior 806. Examples of systems 804 include one or more of propulsion system 808, electrical system 810, hydraulic system 812, environmental system 814, and communications system 816. For example, antenna system 102 shown in FIG. 1 may be implemented in communications system 816. Antenna system 102 in FIG. 1 may be implemented in other systems such as sensors, countermeasures, electronic warfare, or other type of systems in aircraft 800.

In other illustrative of examples, any number of other systems may be included. Although an aerospace example is shown, different illustrative embodiments may be applied to other industries, such as the automotive industry. Apparatuses and methods embodied herein may be employed during at least one of the stages of aircraft manufacturing and service method 700 in FIG. 7.

In one illustrative example, components or subassemblies produced in component and subassembly manufacturing 706 in FIG. 7 may be fabricated or manufactured in a manner similar to components or subassemblies produced while aircraft 800 is in service 712 in FIG. 7. As yet another example, one or more apparatus embodiments, method embodiments, or a combination thereof may be utilized during production stages, such as component and subassembly manufacturing 706 and system integration 708 in FIG. 7. One or more apparatus embodiments, method embodiments, or a combination thereof may be utilized while aircraft 800 is in service 712, during maintenance and service 714 in FIG. 7, or both.

The use of a number of the different illustrative embodiments may substantially expedite the assembly of aircraft 800, reduce the cost of aircraft 800, or both expedite the assembly of aircraft 800 and reduce the cost of aircraft 800. For example, antenna system 102 in FIG. 1 may be implemented during the assembly of aircraft 800 in a manner that reduces the weight and cost of aircraft 800 as compared to other types of antenna systems that provide a wideband capability along with an electronically steered beam.

In this manner, one or more technical solutions in the illustrative examples provide a lightweight, low-profile, and lower cost wideband antenna array as compared to currently used antenna arrays. One or more illustrative examples may reduce the weight of an antenna by 70% or more and the total thickness by up to 50% compared to existing designs, without sacrificing antenna radio frequency performance. Further, one or more illustrative examples also may allow for desired bandwidth and scan angles when electronically steering a beam. Savings in weight occurs through the use of a dielectric substrate, such as printed circuit boards. Further, the use of these printed circuit boards, along with the configuration of slots for the aperture, allow for at least one of a desired bandwidth, such as a wideband application, or desired angles over which the beam may be electronically steered.

The description of the different illustrative embodiments has been presented for purposes of illustration and description and is not intended to be exhaustive or limited to the embodiments in the form disclosed. The different illustrative examples describe components that perform actions or operations. In an illustrative embodiment, a component may be configured to perform the action or operation described. For example, the component may have a configuration or design for a structure that provides the component an ability to perform the action or operation that is described in the illustrative examples as being performed by the component.

Many modifications and variations will be apparent to those of ordinary skill in the art. Further, different illustrative embodiments may provide different features as compared to other desirable embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An antenna system comprising:

an aperture structure comprising a cavity;

a primary radiating slot in the aperture structure;

a tuning slot in the aperture structure; and a stripline feed located between the primary radiating slot and the tuning slot in the aperture structure, wherein a height of the cavity is selected such that backward radiation is redirected to a forward direction for increased antenna gain.

2. The antenna system of claim 1, wherein the stripline feed is offset from a center line of the aperture structure.

3. The antenna system of claim 1, wherein the aperture structure comprises:

a top section having a first dielectric substrate layer with a first metal layer and a second dielectric substrate layer with a second metal layer, wherein the primary radiating slot is formed in the first dielectric substrate layer with the first metal layer, and wherein the tuning slot is formed in the second dielectric substrate layer with the second metal layer;

sidewalls comprising a third dielectric substrate layer and a third metal layer; and a bottom section having a bottom dielectric substrate layer with a bottom metal layer for a ground in the antenna system, wherein the top section, the sidewalls, and the bottom section form the cavity in the aperture structure.

4. The antenna system of claim 3 further comprising:

vias in the top section, wherein the vias define a perimeter around the primary radiating slot and the tuning slot.

5. The antenna system of claim 3, wherein the cavity is filled with a group of materials selected from at least one of air or a foam.

6. The antenna system of claim 3, wherein the cavity is an antenna cavity, and wherein the sidewalls form an electronics cavity in the aperture structure.

7. The antenna system of claim 6 further comprising:

a group of electronic components associated with the electronics cavity, wherein the group of electronic components is selected from at least one of an amplifier, a filter, a phase shifter, or a time delay device.

8. The antenna system of claim 1, wherein at least dimensions and positions of the primary radiating slot, the tuning slot, and the stripline feed are selected for setting an operating bandwidth for the aperture structure.

9. The antenna system of claim 1, wherein at least one of a position or dimensions of the stripline feed are selected for impedance matching to an aperture formed by the primary radiating slot and the tuning slot.

10. The antenna system of claim 1, wherein the primary radiating slot is located below the tuning slot in a top section.

11. The antenna system of claim 1, wherein the primary radiating slot is located above the tuning slot in a top section.

12. The antenna system of claim 1, wherein the aperture structure comprises a top section, sidewalls, and a bottom section formed from printed circuit boards.

13. The antenna system of claim 3, wherein the top section, the sidewalls, and the bottom section are comprised of printed circuit boards that are fabricated separately and bonded together in a final assembly with other aperture structures to form an egg crate structure in an array setting.

14. The antenna system of claim 1, wherein the aperture structure, the primary radiating slot, the tuning slot, and the stripline feed form an antenna element in a wide band antenna array that forms an electronically steered beam.

15. An antenna system comprising:

a top section having a first dielectric substrate layer with a first metal layer and a second dielectric substrate layer, wherein a primary radiating slot is formed in the first dielectric substrate layer with the first metal layer and a tuning slot is formed in the second dielectric substrate layer with a second metal layer;

sidewalls comprising a third dielectric substrate layer and a third metal layer;

a bottom section having a bottom dielectric substrate layer with a bottom metal layer for a ground in the antenna system, wherein the top section, the sidewalls, and the bottom section form an antenna cavity in an aperture structure;

the primary radiating slot in the top section;

the tuning slot in the top section; and a stripline feed located between the primary radiating slot and the tuning slot in the top section that is offset from a center line in the top section, wherein the top section, the sidewalls, and the bottom section form the aperture structure, wherein a height of the antenna cavity is selected such that backward radiation is redirected to a forward direction for increased antenna gain.

16. The antenna system of claim 15 further comprising:

an electronics cavity formed by the sidewalls in the aperture structure.

17. The antenna system of claim 16 further comprising:

a group of electronic components in the electronics cavity, wherein the group of electronic components is selected from at least one of an amplifier, a filter, a phase shifter, or a time delay device.

18. The antenna system of claim 15 further comprising:

vias in the top section, wherein the vias define a perimeter around the primary radiating slot and the tuning slot.

19. The antenna system of claim 15, wherein the top section, the sidewalls, and the bottom section are comprised of printed circuit boards.

20. The antenna system of claim 15, wherein the top section, the sidewalls, and the bottom section are comprised of printed circuit boards that are fabricated separately and bonded together in a final assembly with other aperture structures to form an egg crate structure in an array setting.

21. A method for exchanging radio frequency signals comprising:

exchanging the radio frequency signals using a stripline feed in an aperture structure comprising a cavity, wherein the aperture structure includes a primary radiating slot and a tuning slot, wherein the stripline feed is located between the primary radiating slot and the tuning slot in the aperture structure, and wherein a height of the cavity is selected such that backward radiation is redirected to a forward direction for increased antenna gain.

22. The method of claim 21, wherein the stripline feed is offset from a center line of the aperture structure.

23. The method of claim 21 further comprising:

exchanging the radio frequency signals from other aperture structures arranged in an array with the aperture structure to form a beam.

24. The method of claim 23 further comprising:

electronically steering the beam.

25. The method of claim 21, wherein the aperture structure comprises a top section having a first dielectric substrate layer with a first metal layer and a second dielectric substrate layer with a second metal layer, wherein the primary radiating slot is formed in the first dielectric substrate layer with the first metal layer and the tuning slot is formed in the second dielectric substrate layer with the second metal layer; sidewalls of a third dielectric substrate layer with a third metal layer; and a bottom section having a bottom dielectric substrate layer with a bottom metal layer for a ground in an antenna system, wherein the top section, the sidewalls, and the bottom section form the cavity in the aperture structure.

26. The method of claim 21, wherein a top section, sidewalls, and a bottom section are comprised of printed circuit boards that are fabricated separately and bonded together in a final assembly with other aperture structures to form an egg crate structure in an array setting.

* * * * *